US005237789A

United States Patent [19]

Thaler

[11] Patent Number: 5,237,789

[45] Date of Patent: Aug. 24, 1993

[54] CLAMP FOR A ROOF DEVICE

[75] Inventor: Kenneth Thaler, Parry Sound, Canada

[73] Assignee: Thaler Roofing Specialties Products, Inc.

[21] Appl. No.: 789,261

[22] Filed: Nov. 8, 1991

[51] Int. Cl.[5] ..... E04D 13/14

[52] U.S. Cl. ..... 52/219; 52/199; 285/42

[58] Field of Search ..... 52/198, 199, 218, 219, 52/60; 285/42, 43, 44

[56] References Cited

U.S. PATENT DOCUMENTS

| | | | |
|---|---|---|---|
| 1,174,763 | 3/1916 | Redlon | 285/44 |
| 1,282,535 | 10/1918 | Bropson | 285/44 |
| 1,299,423 | 4/1919 | Bropson | 285/42 |
| 4,630,037 | 12/1986 | Escamilla, Jr. | 52/199 |

FOREIGN PATENT DOCUMENTS

| | | | |
|---|---|---|---|
| 537638 | 2/1957 | Canada | 285/42 |

*Primary Examiner*—Michael Safavi

*Attorney, Agent, or Firm*—Wegner, Cantor, Mueller & Player

[57] ABSTRACT

A clamp for a roof device such as a sleeve for a pipe protruding from a roof having a sealing sheet. There is a skirt, the underside of which abuts a surface of the roof and which underlies the sealing sheet. There is a clamping ring and the sheet is sandwiched between the ring and the skirt. The ring has two lower edges having a downwardly directed concavity defined between them such that a first of the edges abuts the sheet so that an upper surface of the ring may be pressed downwardly by a fastener to press the edge against the sheet to localize compressive forces between the edge, sheet and skirt to seal against entry of water between the sheet and skirt. The device disclosed is a pipe sleeve of spun aluminum. There is a circular base ring adhesively fastened to the underside of the skirt and the clamping ring is circular and of flexible aluminum, with a crescent-shaped cross-section. The arrangement is such that the circumferential edges of the clamping ring are coextensive with the circular base ring. Typically the elements of the device have communicating apertures for insertion of bolts upwardly therethrough and nuts are screwed onto the bolts for fastening of the elements together.

15 Claims, 3 Drawing Sheets

CLAMP FOR A ROOF DEVICE

FIELD OF THE INVENTION

This invention is in the field of clamps for securing in place a pipe sleeve or the like which protrudes from a roof, while preventing entry of water into the joint between the sleeve and the roof. In particular, this invention relates to a device having a skirt which underlies a roofing membrane and a clamping ring which overlies the membrane to sandwich the membrane, wherein the skirt and ring are mechanically fastened to each other.

BACKGROUND OF THE INVENTION

It is well known in the building trades to install pipes and the like which protrude from a roof, which pipes provide ventillation, exhaust, etc. One approach to sealing the joint between a pipe and roof has been to extend roofing material, such as non-bituminous membranes of polyvinyl chloride (PVC), ethylene propylene diene monomer polymers (EPDM), Hypolon, neoprene and other rubbers, sheet lead, and bituminous membranes, etc. up the sides of the pipe and down into the pipe. Other approaches include the use of skirted cylindrical pipe sleeves which surround the pipe. These approaches heretofore have generally involved the use of lap sealants, etc. to seal the gaps between the pipe, sleeve and roof. Further, ring clamps are often employed in these arrangements to ensure a water-tight seal between the pipe and upright sleeve.

GENERAL DESCRIPTION OF THE INVENTION

A roof device of the present invention is for fastening to a roof having a sealing sheet. The device includes a skirt which abuts a surface of the roof. An outer surrounding portion of the skirt underlies a portion of the sheet when the device is installed. There is a clamping ring dimensioned to overly the skirt so as to sandwich the sheet between the underlying skirt and the overlying ring. The clamping ring has a cross-section shaped such that there are two lower edges, one of which is radially inward of the other. There is a downwardly directed concavity defined between the lower edges and at least one of the edges abuts the sheet. The ring may be pressed downwardly by a fastener to press the abutting edge against the sheet to localize compressive forces between the ring edge, sheet and skirt to obtain a seal against entry of water between the sheet and skirt.

The skirt of the disclosed embodiment has a rigid thickened portion located to be coextensive with at least the sealing edge of the ring. The preferred embodiment device is a sleeve for a pipe and is of spun aluminum. The thickened portion is a cast aluminum circular ring adhesively bonded to the underside of the skirt.

The clamping ring of the disclosed embodiment is circular and has a cross-section of a "U"-shape or crescent shape, so as to have two lower concentric edges which are coextensive with the cast aluminum ring. Fasteners include threaded bolts which protrude through openings in the skirt, sheet and clamping ring so as to receive threaded nuts which compress the clamping ring downwardly when threaded onto the bolts.

DETAILED DESCRIPTION OF PREFERRED EMBODIMENTS

Figure 1:
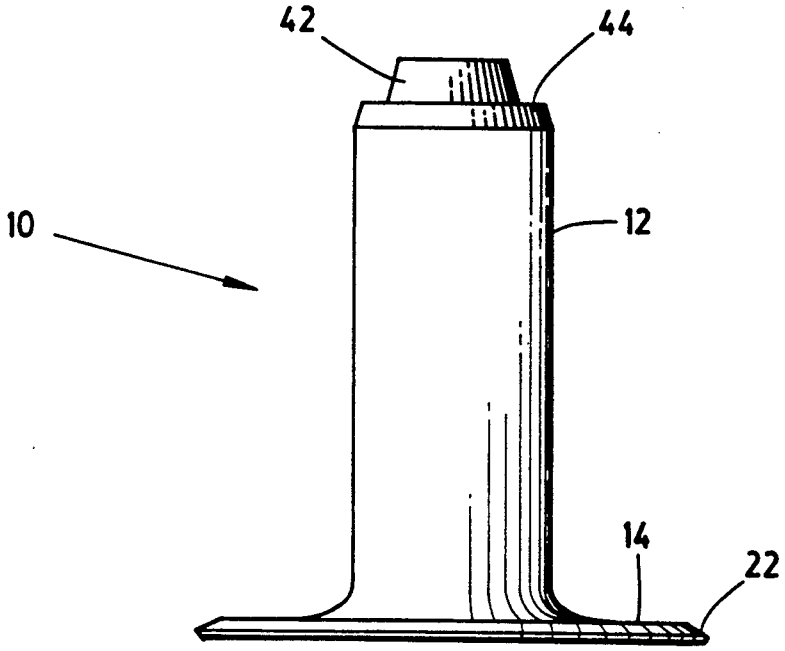
FIG. 1 is a side elevation of a preferred embodiment pipe sleeve of the present invention.
Figure 2:
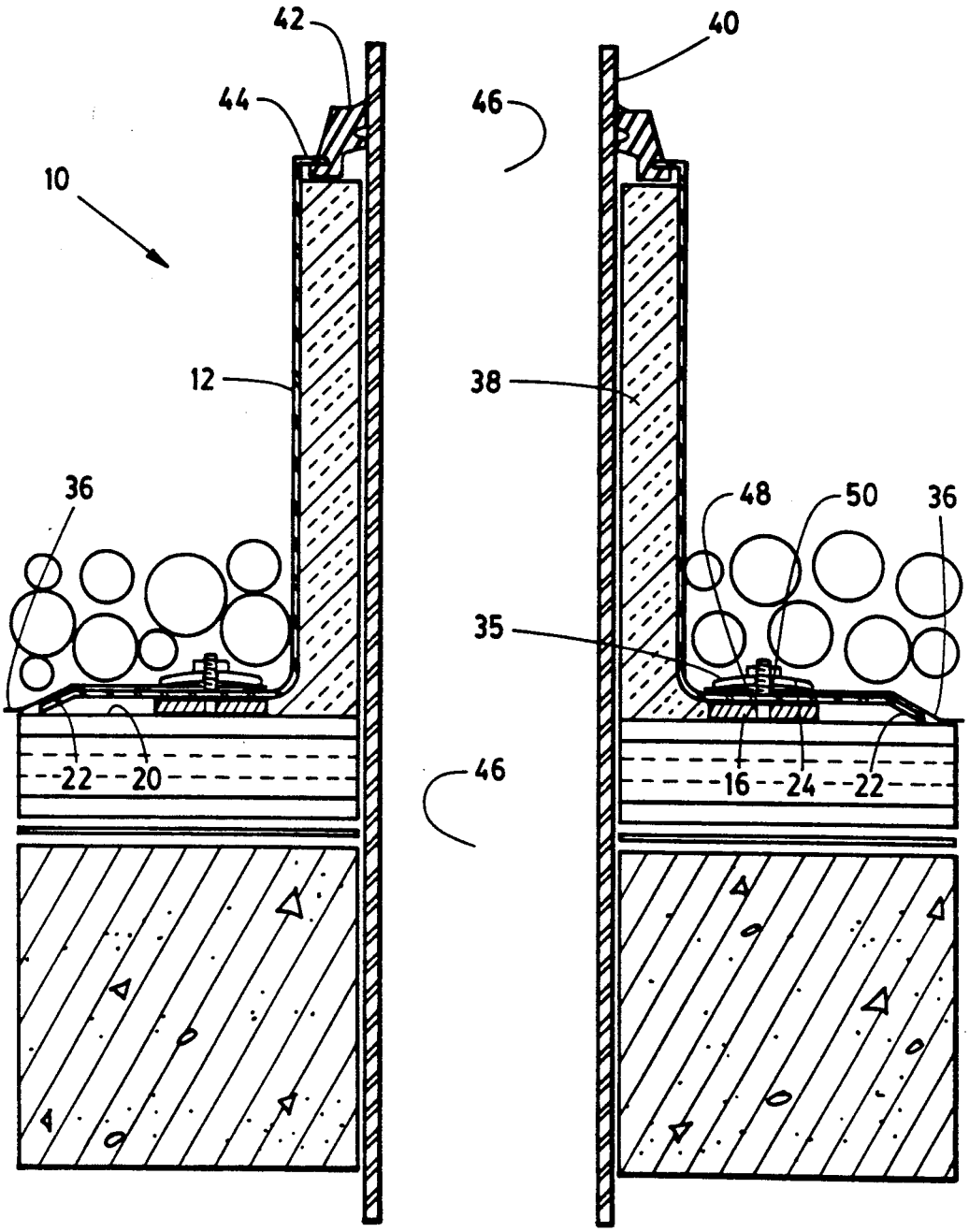
FIG. 2 is a sectional elevation of the FIG. 1 embodiment installed on a roof.
Figure 3:
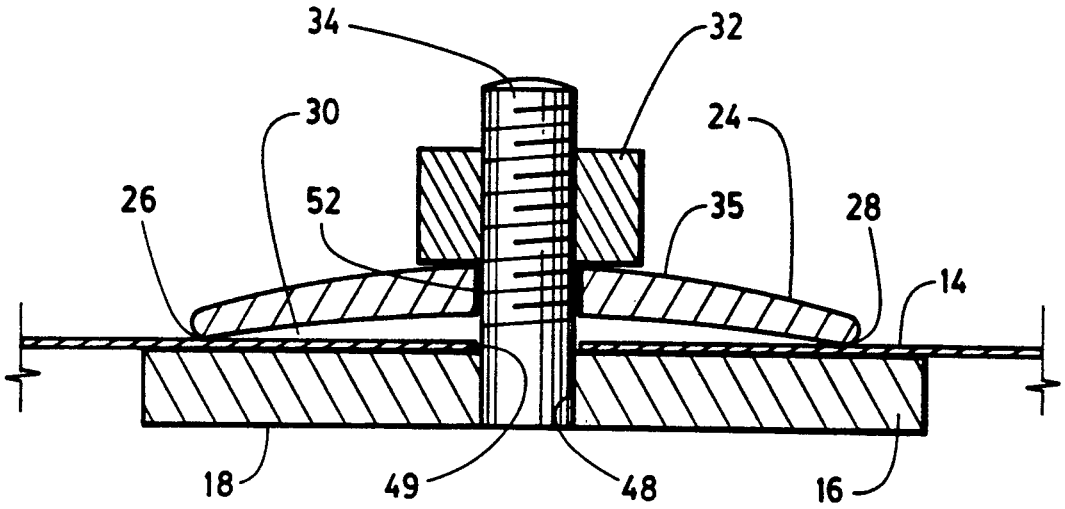
FIG. 3 is sectional detail of a clamping portion of the FIG. 1 embodiment shown in FIG. 3 absent the roof sealing sheet.
Figure 4:
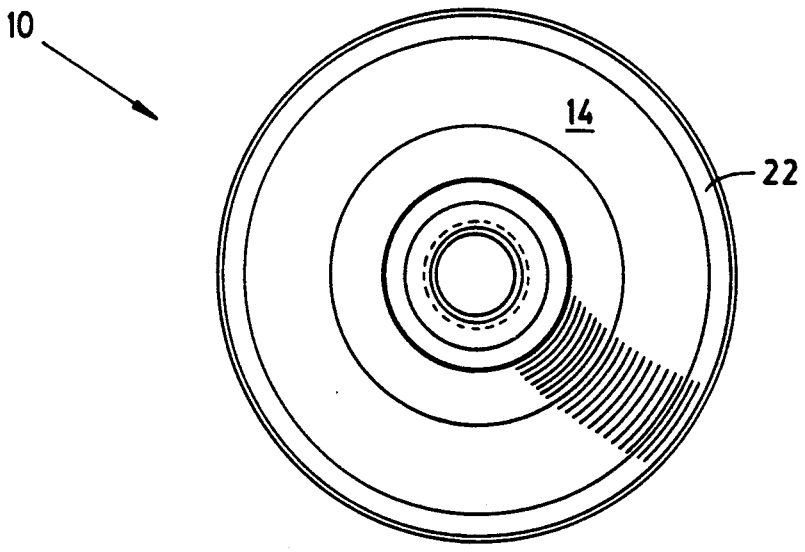
FIG. 4 is top plan view of the FIG. 1 embodiment.

Turning to FIGS. 1–3, a preferred embodiment pipe sleeve 10 is illustrated. The sleeve includes an upright circular cylinder 12 having lower skirt 14 extending radially outward therefrom. A rigid thickened portion of the skirt is provided by circular base member 16 fastened to the underside of the skirt. Lower surface 18 of base member 16 abuts building roof 20 of an installed sleeve, as best seen in FIG. 2. The skirt has a downwardly depending circumferential lip 22 which is located to abut roof 20 when installed. Circular clamping ring 24, having a cross-section in the shape of an inverted "U", has two lower edges 26, 28 between which is defined concavity 30 which edges abut roof sealing sheet 36 when installed. Nuts 32 and bolts 34 fasten the skirt and ring together with roof sealing sheet 36 sandwiched between the skirt and ring.

Cylinder 12 is provided with a urethane liner 38 to insulate installed pipe 40. Pipe 40 typically has a 4" outer diameter, but may be of any suitable diameter. The cylinder is typically between 12" and 18" in height, but such dimensions are chosen as would be suitable for a particular application. Grommet 42 sealingly abuts between the top end 44 of the cylinder and the pipe to prevent entry of water between the sleeve and the pipe, this type of sealing arrangement being generally known in the art.

When installed, the cylinder protrudes upwardly through an opening 46 in the sealing sheet of the roof while the skirt underlies the sheet. Threaded ends of bolts 34 protrude upwardly through small holes 48, 49 of the base member and skirt respectively, and through small holes 50 in the sheet. Clamping ring 24 having holes 52 spaced to coincide, that is communicate with holes in the skirt and base ring, is placed so as to sandwich the sheet between the ring and the skirt with the bolts inserted through its holes. Nuts are then screwed onto the bolts to fasten the sleeve in place. The skirt and base member may have additional holes, typically three evenly spaced from each other on a common circle, for use in bolting the sleeve to the roof deck. Such additional fastening of the sleeve would be typical where the roofing membrane is loosely laid.

The cylinder and skirt of the preferred embodiment illustrated are a unitary body of spun aluminum. The base member is a ring of rectangular cross-section of cast aluminum adhesively bonded by any suitable cement to the underside of the skirt. The clamping ring is also of cast aluminum and is flexible in the sense that when nuts 32 are screwed onto bolts 34 to press against the upper surface 35 of the ring, the ring flexes as it is compressed towards the skirt and lower edges 26, 28 of the ring abut against the sheet sufficiently to seal the joint area between the sheet and skirt against ingress of water. As seen in FIGS. 2 and 3, base member 16 is dimensioned to be coextensive with ring edges 26, 28 so that the edges are located to press the sheet ie, membrane, against the skirt portion overlying the base member.

The main member and base member are preferably of aluminum, but may be of any suitable material, such as stainless steel, copper, PVC, etc. The clamping ring may be any suitable material.

FIG. 2 illustrates bolts located on a diametrical line of the base ring. Typically, the outside diameter of the base ring is about 10 inches and the inside diameter is about 6 inches so that its width is about 2 inches. These diametrical dimensions may be varied, as suitable. The thickness is typically a quarter inch while the concavity would have a maximum height, before compression, of about 0.19 inches. Quarter inch diameter stainless steel bolts are preferred, but any suitable material may be used. Preferably, the bolts are spaced no more than 7 inches apart as measured on an arc of a circle of the base ring on which they are located, but a closer spacing may be used. The illustrated embodiments have been found to provide a suitable seal for sealing sheets made of PVC, EPDM, Hypolon, neoprene and other rubbers, bituminous membranes and sheet lead, but sealing sheets of other suitable material may be used.

The disclosed embodiment, while being exemplary of the invention disclosed herein, is not intended to limit the scope of protection of the invention as defined by the appended claims.

What is claimed is:

1. In a roof device for fastening to a roof having a sealing sheet, a clamp comprising:

(a) a skirt having an underside for abutment with a surface of the roof, which skirt has an outer surrounding portion dimentioned to underly a portion of the sheet;

(b) a clamping ring, dimensioned to overly the portion of the skirt so as to sandwich the portion of the sheet between the skirt and ring; wherein:

(c) the ring has two lower edges having a downwardly directed concavity defined therebetween and a first of the edges abuts the sheet such that an upper surface of the ring may be pressed downwardly by a fastener to press the edge against the sheet to localize compressive forces between the first ring edge, sheet and skirt to obtain a seal against entry of water between the sheet and skirt; and (d) the skirt has a rigid thickened portion provided by a base member fastened to an underside of the skirt, located to be coextensive with at least the first edge of the ring.

2. The device of claim 1 wherein a second of the edges of the clamping ring abuts the sheet to obtain a seal against water entry between the sheet and skirt when the ring is pressed downwardly.

3. The device of claim 3 wherein the clamping ring is of metal.

4. The device of claim 3 wherein the clamping ring has a generally inverted "U"-shaped cross-section.

5. The device of claim 2 wherein the thickened portion is coextensive with the first and second edges of the ring.

6. The device of claim 2 wherein device is manufactured of spun metal and, the skirt and ring are each circular.

7. The device of claim 6 wherein the base member is a circular base ring.

8. The device of claim 7 wherein the circular base ring is adhesively bonded to the underside of the skirt.

9. The device of claim 8, wherein the clamp and circular base ring are of aluminum.

10. The device of claim 1 wherein the skirt is provided with a downwardly depending circumferential lip having a lower edge to abut the roof.

11. The device of claim 1, for use as a pipe sleeve, further comprising an upright cylinder central of the skirt.

12. The device of claim 11, further comprising an insulative liner for the cylinder.

13. The device of claim 12 wherein the cylinder has an open top end and further comprising a sealing grommet at the top end for sealing against water ingress between the sleeve and pipe.

14. The device of claim 1 wherein the skirt has a plurality of spaced first holes for receipt of fasteners therethrough, which holes are located for insertion of the fasteners through the clamping ring.

15. The device of claim 14 wherein the the clamping ring has a plurality of second holes for insertion of fasteners therethrough, which second holes are located to communicate with the first holes.

* * * * *

UNITED STATES PATENT AND TRADEMARK OFFICE

CERTIFICATE OF CORRECTION

PATENT NO. : 5,237,789

DATED : August 24, 1993

INVENTOR(S) : Kenneth Thaler

It is certified that error appears in the above-identified patent and that said Letters Patent is hereby corrected as shown below:

Col. 3, line 36, delete "dimentioned" and substitute --dimensioned--.

Col. 4, line 11, delete "3" and substitute --2--.

Col. 4, line 18, delete "2" and substitute --5--.

Signed and Sealed this

Twenty-fourth Day of May, 1994

*Attest:*

Bruce Lehman

BRUCE LEHMAN

*Attesting Officer*

*Commissioner of Patents and Trademarks*